United States Patent [19]

Hain

[11] Patent Number: 4,875,666

[45] Date of Patent: Oct. 24, 1989

[54] CLAMP FOR HOLDING WORK PIECES IN THE FORMATION OF TRUSSES

[76] Inventor: Leonard P. Hain, P.O. Box 238, Rescue, Calif. 95672

[21] Appl. No.: 68,021

[22] Filed: Jun. 30, 1987

[51] Int. Cl.[4] ..... B25B 1/10

[52] U.S. Cl. ..... 269/37; 269/268; 269/900; 269/910

[58] Field of Search ..... 100/913, 100; 29/798, 29/281.3; 227/152; 144/288 C; 269/45, 268, 37, 257, 900, 910, 244, 204

[56] References Cited

U.S. PATENT DOCUMENTS

| | | | |
|---|---|---|---|
| 1,450,940 | 4/1923 | Cobb | 269/204 |
| 4,379,426 | 4/1983 | Thompson et al. | 100/913 |
| 4,679,781 | 7/1987 | Le Poire | 269/910 |
| 4,743,004 | 5/1988 | Klass | 269/900 |

*Primary Examiner*—Robert C. Watson
*Attorney, Agent, or Firm*—Leonard Bloom

[57] ABSTRACT

A clamp for holding lumber which is used to form roof trusses. A plurality of clamps are placed on a work table oriented to constrain plural pieces of lumber forming the truss until truss plates attach ends of adjacent pieces of lumber. The clamp includes an inner and outer sleeve, the inner sleeve telescopes with respect to the outer sleeve and a spring bias connection exists between the inner and outer sleeve through a threaded shaft which causes the inner sleeve to telescope so that imperfections in the lumber can be accounted for and several identically configured trusses can be formed without removing the clamps from the table. Specific types of clamp support for the lumber as well as a specific means for supporting the clamp on the work table is disclosed. An embodiment is disclosed which includes an inner and outer sleeve, where the inner sleeve telescopes with respect to the outer sleeve and is frictionally retained along with spring biasing to allow the inner sleeve to be placed relative to the outer sleeve.

9 Claims, 3 Drawing Sheets

CLAMP FOR HOLDING WORK PIECES IN THE FORMATION OF TRUSSES

FIELD OF THE INVENTION

The following invention relates generally to an apparatus to be used on a work surface which holds pieces of lumber in specific configurations for forming the pieces of lumber into trusses. More specifically, a work holder clamp is provided which releasably attaches to a work supporting table and can accomodate a plurality of diverse finished truss configurations while being easily removeable from and adjustable on the work supporting table.

BACKGROUND OF THE INVENTION

The technique for forming trusses for use as roof supports in buildings traditionally involves placement of pieces of lumber which are to form the truss on a work table having a plurality of threaded bores passing therethrough. The lumber is held in a fixed geometric configuration by means of plural work holders strategically placed about different aspects of the lumber so that areas for interconnection of adjacent pieces of lumber are secure for fastening a truss plate thereat.

One of the reasons for standardized housing has been that the use of custom roof designs entails labor intensive modification of truss forming arrangments on such a work table, sometimes involving custom fabrication of a work table since hole placement for the lumber holding jigs may not be properly spaced to accomodate the unique truss design. More frequently however, unique roof (and therefor truss) design entails placement of the jig holders in unfamiliar sites causing increased down time in order to visually comprehend the overall layout prior to fastening adjacent pieces of lumber together through truss plates.

The following patents exemplify the rather rich state of the art in an attempt to overcome this long felt yet heretofore unsatisfied need, and the particular relevance of any patent, either singularly or combined in any conceivable combination is not seen to diminish the patentability of the instant application as set forth hereinafter. Moreover, citation of these patents is in direct response to applicant's acknowledged duty to disclose prior art.

| | | |
|---|---|---|
| 3,068,484 | Moehlenpah et al | December 18, 1962 |
| 1,828,791 | Thompson | October 27, 1931 |
| 2,415,259 | Renton | February 4, 1947 |
| 4,046,364 | Coope et al | September 6, 1977 |
| 3,826,188 | Eberle | July 30, 1974 |
| 4,126,259 | Galer et al | November 21, 1978 |
| 4,148,471 | Werner | April 10, 1979 |
| 4,071,061 | Schneider | January 31, 1978 |
| 3,255,943 | Sanford | June 14, 1966 |
| 3,394,389 | Amir | July 23, 1968 |
| 3,329,328 | Jureit et al | July 4, 1967 |
| 3,238,867 | Jureit et al | March 8, 1966 |
| 4,524,960 | LePoire | June 25, 1985 |

SUMMARY OF THE INVENTION

The instant invention teaches the use of a lumber retaining clamp which can be oriented such that clamp engaging holes contained upon the work table do not have to be precisely spaced in order to make the clamp effective.

A roller at one end of the clamp comes in contact with at least one piece of truss lumber. Once assembled, the truss can be easily removed by prying the truss beyond the clamp or by engaging an automatic truss ejector. The roller can also be backed off the lumber to release its pressure.

The main body of the clamp includes a pair of downwardly extending studs. The distance between these studs is adjustable so that any stud may fit within one of several bores on the work table adjacent to the lumber to be clamped. A tightening device formed as a screw in the body of the clamp allows independent tensioning of one of the studs so as to adequately locate the clamp on the work table. In this way, should the bores on the work table not precisely match a specific portion of truss framework, flexibility is provided in the adjustable clamp. By providing the clamp with a roller which holds the lumber into place, the lumber can be securely held on the work table until truss plates connecting adjacent pieces of lumber are fixed, and yet the completed truss can be removed without unclamping by ejecting the truss. Thus if several identical trusses are to be formed, down time between successive truss fabrications is kept to a minimum.

In addition, the roller which engages the truss framework may be spring biased to accomodate sections of lumber which are not truly linear or squared. With the advent of lumber harvesting techniques which have devised methods for using what heretofore had been cull wood, linearity along longitudinal aspects of the lumber is no longer common place, and indeed appears to be the exception rather than the rule. The spring biasing of the clamp can accomodate bowed sections of the lumber without readjusting the pattern set on the work table.

OBJECTS OF THE INVENTION

Accordingly, it is a primary object of the instant invention to provide a new and novel clamp for use on truss fabricating work tables particularly used in fabricating roofs of houses and commercial buildings.

It is yet another object of this invention to provide a device as characterized above which is extremely durable and simple in construction and will facilitate assembly of the pattern to which the lumber forming the truss is to be oriented.

A further object of this invention contemplates a device as set forth above wherein the heretofore strict requirement of stud alignment from the clamp to the work table has been obviated.

A further object of this invention contemplates providing a device as characterized above wherein a stud fractured within a threaded bore on the work table can be expeditiously removed. Moreover, threaded studs and work tables can be replaced by unthreaded pins and bores. Thus, the clamp can be easily repaired when damaged since a broken, unthreaded pin will merely fall through the table.

A further object of this invention contemplates providing a device as characterized above which can accomodate lumber used in formation of the truss which is not totally planar or squared along all of its aspects.

A further object of this invention contemplates providing a device as characterized above which will lend itself to placement not only on metal work table, but also work tables formed from wood.

A further object of this invention contemplates providing a device as characterized above which benefits from the economies of scale associated with mass production techniques.

It is an object of this invention to provide a device for forming roof trusses in which a telescope truss engaging clamp has an inner and outer tube, the inner tube concentrically disposed within the outer tube, a threaded shaft axially centered within the tubes, held by the outer tube and threaded to the inner tube whereby rotation of the shaft axially translates the inner tube, and a spring along the threaded shaft between said inner and outer tubes such that play exists therebetween.

It is a further object of this invention to provide a device wherein the threaded shaft is held by the outer tube by means of a pair of jam nuts carried on a free end of the threaded shaft which passes through a block member fixed on the outer tube and having a bore slightly greater than the dimension of the threaded shaft so that the threaded shaft passes freely therebyeond, the block including a cup counter bored within the block dimensioned to receive a spring therein, the spring overlying the threaded shaft and spaced from an end of the inner tube by means of a second pair of jam nuts, the inner tube adjacent the second pair of jam nuts having a threaded bore complimental to the pitch of the threaded shaft for advancement of the inner tube.

A further object of this invention is to provide a device wherein the inner tube has a second end remote from the threaded bore provided with a means for contacting the lumber forming the truss.

A further object of this invention is to provide a device including means for removeably attaching said clamp to a work table including a clamp tube having one side edge thereof attached to said outer tube, a second threaded shaft passing along an interior of said clamp tube axially and pin means extending from said clamp tube to engage corresponding apertures to the work table.

It is yet a further object of this invention to provide a device wherein the one pin means is fixed to the clamp tube and a second pin means is constrained to ride on the threaded shaft whereby rotation of the threaded shaft advances the second pin means along the length of the second threaded shaft.

A further object of this invention is to provide a device wherein the second threaded shaft is fixed within the clamp tube by means of a pair of jam nuts carried on a free end of the second threaded shaft, the first pin means including a block fixed within the clamp tube having a bore through which the second threaded shaft passes, the bore dimensioned to not engage the second threaded shaft, and the second pin means includes a second block having a bore through which the second threaded shaft passes, the last named bore having a thread pitch complimental to the pitch of the secnd threaded shaft for advancement of the second block along the second threaded shaft.

A further object is to provide a device wherein the means for engaging the lumber include at least one roller carried a said free end of the inner tube.

A further object is to alternatively provide a device wherein the free end of the inner tube which engages the lumber forming the truss includes a pair of ears which straddle the inner tube and connected thereto, a plate supported by the ears which in turn carries a pair of hemispherical plates such that an arcuate surface of one hemispherical plate extends away from the ears and the second hemispherical plate is attached thereto by means of a bolt.

A further object of this invention is to provide a device wherein means are provided for attachment to a work surface including a pair of flanges extending out from said outer tube having a plurality of apertures thereon through which nails pass to fix said clamp on the work surface.

It is an object of this invention to provide a device for positioning lumber on a work surface in forming a roof truss or the like, having abutment means oriented adjacent to the lumber to constrain the lumber from displacement, biased telescoping means connected to the abutment means to advance or retract the abutment means with respect to the lumber, for positioning, the attachment means for securing the device to the work surface.

It is an object of this invention to provide a method for forming roof trusses or the like including the steps of making general patterns of the truss to be formed by placing precut pieces of lumber in the general pattern on a work surface, holding each piece of lumber in position by manipulating a plurality of clamps by, removeably fixing each clamp to the table, telescopically altering the overall length of the clamps to address the lumber, while preserving resilient biasing within the clamps, connecting the pieces of lumber with truss plates, and ejecting the formed truss.

It is yet a another object of this invention to include the steps of forming identical subsequent trusses by placing further precut pieces of lumber into the general pattern of a work surface while the plurality of clamps remain in their original configuration, pressing the pieces of lumber into a fixed position by depressing the lumber past portions of the clamps that abut against the lumber thereby tensioning the resilient biasing within each clamp and connecting the pieces of lumber with a truss plate and finally ejecting the thus formed truss.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
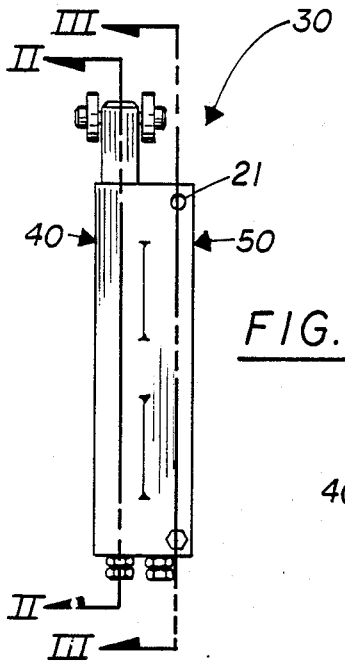
FIG. 1 is a top plan view of the apparatus according to the present invention.

Referring to the drawings now, wherein like reference numerals refer to like parts throughout the various drawing figures, reference numeral 30 is directed to the truss clamp according to the present invention. In essence, the clamp 30 is formed from two parts. A first part 40 includes a means for abutment against the object to be worked and telescoping means is associated therewith to adjust the abutment means as is required. A second part 50 includes a means by which the clamp 30 can be removeably attached to a work table.

More particularly, the first part 40 of the clamp 30 includes a first tube assembly (guide way) having an exterior four sided tube 5 within which a four sided telescoping tube 4 is slideably inserted. An exposed external extremity 4c of the telescoping tube 4 supports a pair of rollers 1 on diametrically opposed sides thereof. The rollers 1 are carried on shoulder bolts 2 which pass through the extremity 4c and the bolts are threaded on a block fixed in the tube 4. If desired, an access hole (not shown) can be placed on a side of the telescoping tube 4 at the extremity 4c to gain access to the tube's interior during fabrication. Thereafter the access hole is welded closed.

The interior of the telescoping tube 4 is hollow and contains a threaded shaft 12 extending beyond the length of the tube 4 and away from the rollers 1. An end of the telescoping tube 4 remote from the rollers 1 is a capped end 4a provided with a thread 4b complimental to the pitch of the thread on the shaft 12 whereby rotation of the shaft 12 in a manner to be defined causes motion of the telescoping tube 4 in the direction of a double ended arrow "A".

An end of the exterior tube 5 remote from the rollers 1 supports a stationary block 24 through which the threaded shaft 12 passes, but the bore of block 25 is dimensioned such that the threads on the shaft 12 will not engage the bore. A free end of the threaded shaft 12 adjacent block 24 carries a pair of jam nuts 19 thereon so that a hand tool (not shown) can easily rotate the threaded shaft 12. It is evident that since the telescoping tube 4 and the exterior tube 5 are of rectangular or square stock, rotation of the threaded shaft 12 causes axial translation of the telescoping tube 4.

Figure 2:
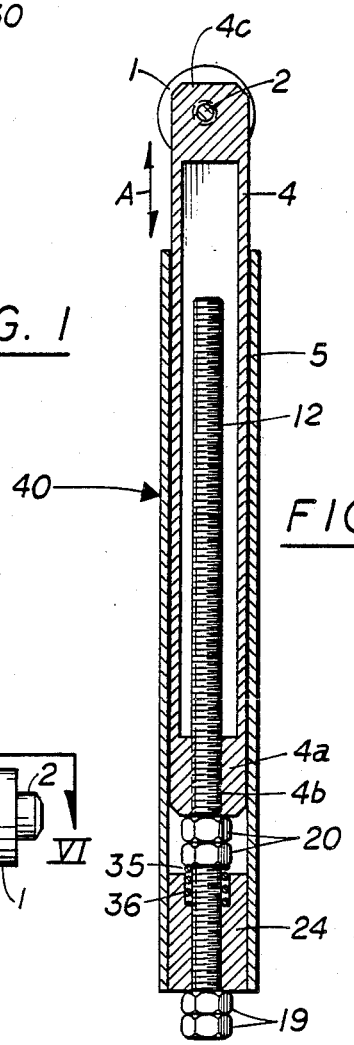
FIG. 2 is a sectional view taken along line 2—2 of FIG. 1.

FIG. 2 reveals that a second pair of jam nuts 20 serving as a stop are interposed between the block 24 and the capped end 4a of the telescoping tube 4. Underlying the two jam nuts 20, a spring 35 seated in a counter bored cup 36 contained in the block 24 will allow a degree of damping for the roller assembly 1.

Assume that the lumber chosen to form the truss includes one edge which is not 90 degrees or (worse) is rounded. The built in spring biasing of roller assembly 1 will allow axial translation of the telescoping tube 4 against spring pressure to accomodate variations in the lumber, including bowed lumber without readjustment of threaded shaft 12.

Figure 3:
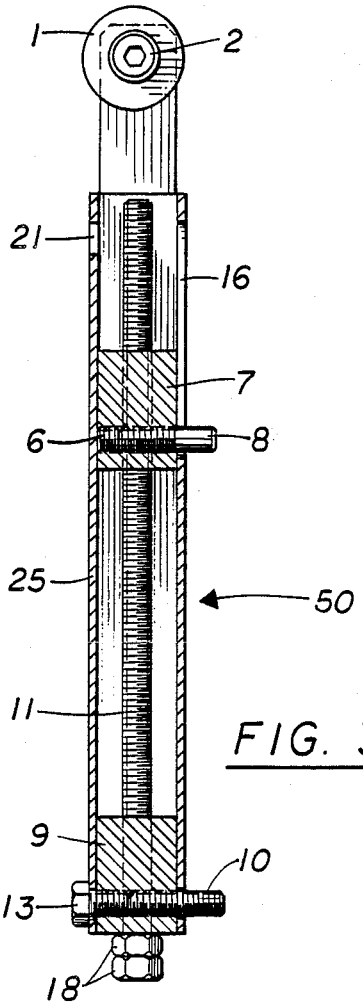
FIG. 3 is a sectional view than along line 3—3 of FIG. 1.
Figure 4:
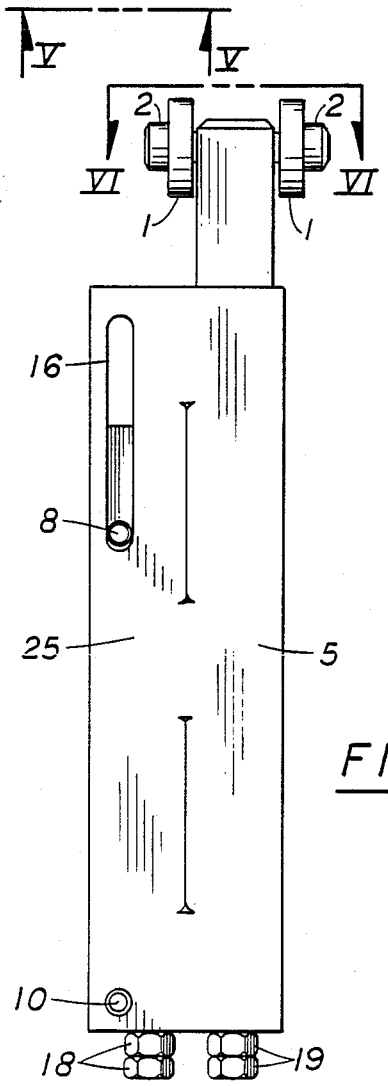
FIG. 4 is a plan view of that which is shown in FIG. 1 on an opposite side thereof.
Figure 5:
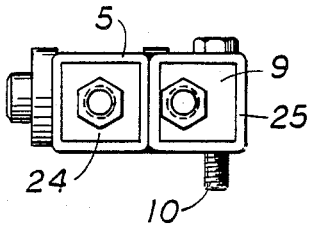
FIG. 5 is an end view taken along lines 5—5 of FIG. 1.
Figure 6:
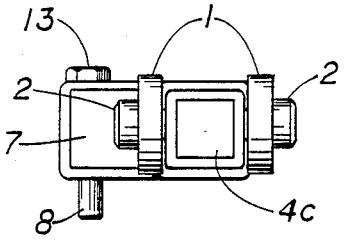
FIG. 6 is an opposite end view taken along lines 6—6 of FIG. 4.

The means 50 by which the clamp 30 can be retained on a work table will now be explored. With particular reference to FIG. 3, a second tube assembly having a clamp tube 24 of substantially square section is welded to the tube 5 along one exterior side surface. The clamp tube 25 supports a second threaded shaft 11 running along its longitudinal axis. Carried at one end of clamp tube 25, remote from the roller 1, a block 9 is fixed by means of a first bolt 13 which threads into the block 9. A stud 10 passes through the clamp tube 25 and the block 9 on an opposite side. A free end of the bolt 13 bears upon and locks the stud 10. Thus, if broken, stud 10 can be quickly replaced by backing off the bolt 13. Alternatively, the bolt 13 and stud 10 can be one piece. Since the block 9 is fixed, the bore which accomodates the threaded shaft 11 through the block 9 will allow rotation of the threaded shaft 11 without effect on the block 9. A free end of the shaft 11 remote from the block 9 carries a slide block 7 having an internal bore with a thread pitch complemental to the thread on shaft 11 so that axial translation of the slide block occurs upon rotation of the threaded shaft 11. A pair of jam nuts 18 exteriorly of the block 9 facilitates rotation of the threaded shaft 11.

The slide block 7 includes a threaded passageway engaging a set screw 6 on a top surface thereof. An opposite side of the slide block 7 and axially aligned with the set screw 6 supports a downwardly depending stud 8. The stud (second bolt) 8 finds clearance to move along the length of the clamp tube 25 by means of a slot 16 passing through a wall of the tube 25. As shown in the drawing figures, and access hole 21 is provided on a side of the clamp tube 25 to align with the set screw 6. Should the stud 8 break in the work table, the clamp 30 is removed from the table and the slide block 7 can be manipulated so that the set screw 6 is in alignment with the access hole 21, whereby loosening of the set screw will "unlock" the stud 8 for easy removal and replacement. As noted above, the free end of stud 8 or bolt stud 10 need not be threaded since the clamp 30 is actually wedged between holes on the work surface. This allows the work surface to be less expensive to make and allows easy removal of broken studs not only from the work table but also from the clamp.

In use and operation, the block 9 having a stud 10 passing through a bottom of the clamp 30 locates (keys) in one of the bores on a work table and the stud 8 in another hole. The distance between the stationary block 9 and the slide block 7 can be varied to allow alignment of these studs by rotation of the threaded shaft 11. Telescoping advancement of the telescoping tube 4 will allow the rollers 1 to come in contact with lumber. When a plurality of these clamps 30 are used, various complicated jig orientations can be effected for fabricating trusses of diverse configuration. Removal of the completed truss is of minimal effort since the rollers will allow motion of the truss off of the work table yet the clamp 30 can remain in its settled position ready for the next truss to be formed. The spring 35 and its biasing associated with the telescoping tube allows a new piece of lumber to be pressed or hammered into place with the spring providing sufficient give to allow a new piece of lumber to be replaced thereat.

Figure 8:
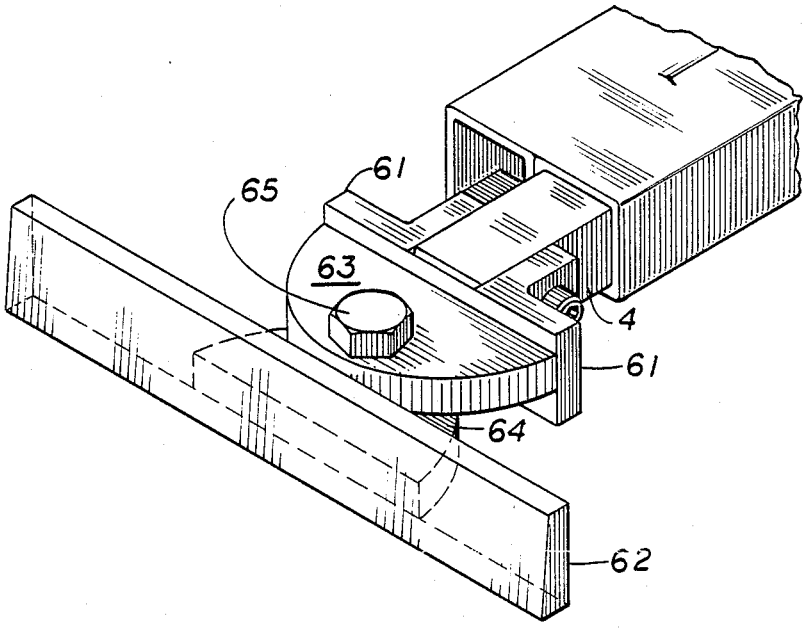
FIG. 8 is a perspective view of one end of the device shown in FIGS. 1-6 with a replacement for the roller during special applications.

Although a roller is shown in one illustrative embodiment, the telescoping tube 4 of FIG. 8 supports two outwardly. extending ears 61 and a metal plate either linear 62 and/or semicircular 63 which can abut against one face of the lumber L to be worked on. Note that two semicircular plates 63, 64 are shown attached by a bolt 65 about facing, arcuate surfaces which overlap slightly.

Figure 7:
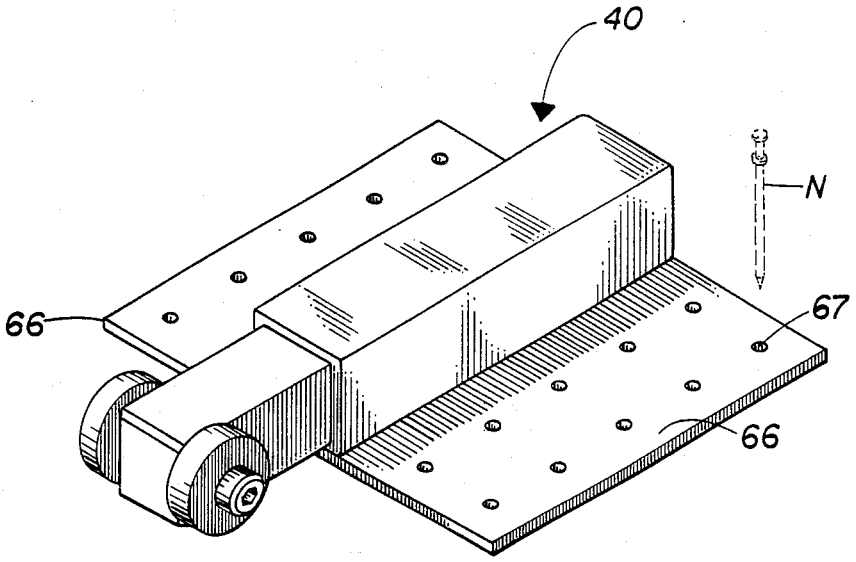
FIG. 7 is a perspective view of a second form of the invention.

In addition, the means by which the clamp 40 is attached to a work table can be varied as shown in FIG. 7 is a metal work table having machine bored holes is not available. In this eventuality, flanges 66 extending from either side of the clamp 40 are provided were apertures 67 through which double headed nails N can be placed to fix the clamp on a wooden surface.

Figure 9:
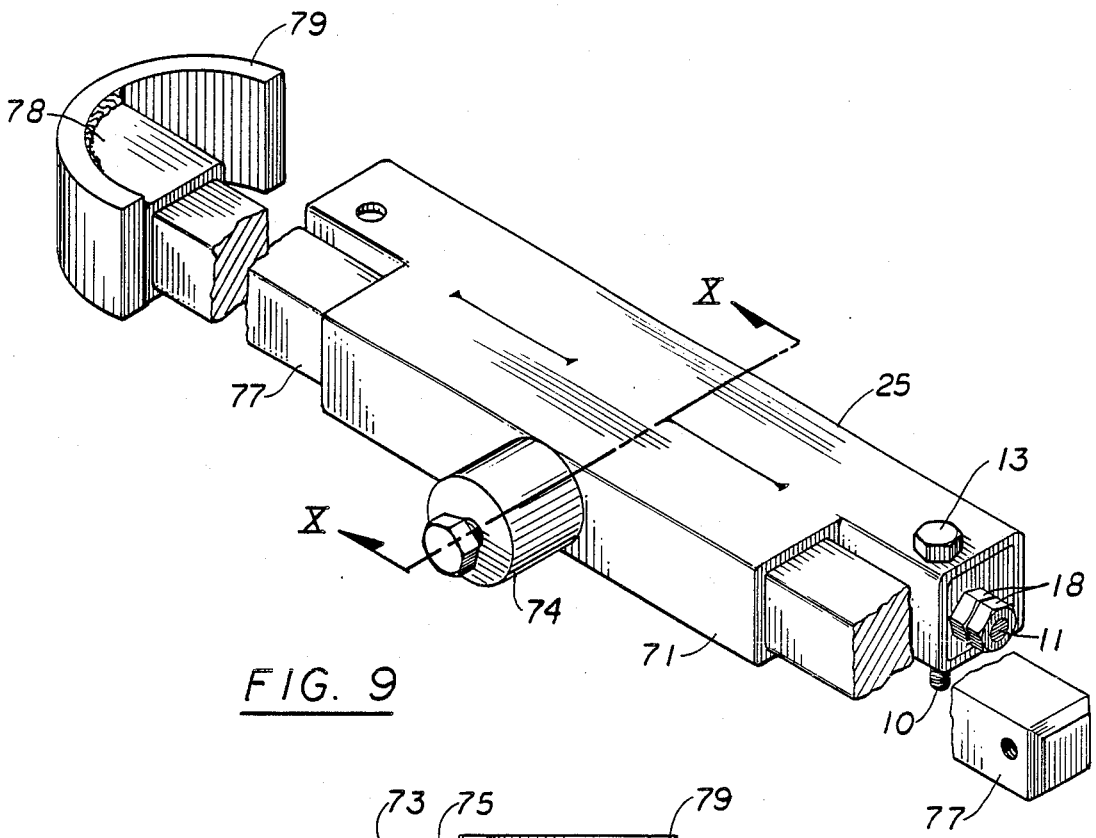
FIG. 9 is a perspective view of a third form of the invention.
Figure 10:
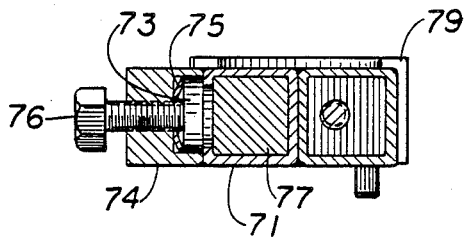
FIG. 10 is a sectional view taken along lines 10—10 of FIG. 9.

FIGS. 9 and 10 reflect yet a third embodiment having features which may be hybridized with the foregoing. More particularly, and with specific reference to FIG. 9, the means by which this clamp attaches to the work table appears similar to the first embodiment, FIGS. 1–6. Thus, like reference numerals refer to like parts. The means by which the truss is engaged by the clamp however, has been varied. More particularly, a tubular housing 71 of substantially rectangular configuration slideably receives therewithin bar stock 77 having an external configuration complemental to the inner diameter of the tubular housing 71. An end which abuts against lumber forming the truss can ether be configured as the arrangements shown in FIGS. 1–8, or may take the form of an arcuate plate 79 fixed on an end of the bar stock 77 by means of sleeve 78 dimensioned substantially the same as housing 71.

Bar stock 77 is fixed in position with respect to tubular housing 71 in the following manner. A bolt 76 extends from a side wall of tubular housing 71 and is supported in a fixed (locked) position by means of a cap 74 of substantially annular configuration and having an end wall provided with threads complemented to the pitch of the threads of the bolt 76 so that the bolt 76 can be advanced in a direction transverse to the longitudinal axis of the bar stock 77. An interior of the cap 74 supports a puck 73 having a necked down portion which can frictionally contact the bar stock 77 with sufficient clearance being provided so that the magnitude of the frictional contact of the puck 73 can be adjusted by means of bolt 76. To facilitate this adjustment and to allow temporary disengagement of the frictional relation between the puck 73 and the bar stock 77, a washer 75 having spring characteristics (a belleville spring, for example) is interposed between the bolt 76 and the puck 73 so that in use and operation this clamp operates as follows.

The bar stock 77 can be axially advanced by blows from a hammer at a free end remote from plate 79 for example, because force of sufficient magnitude will overcome the coefficient of friction that exists between the puck 73 at its area of tangential contact with the bar stock 77 caused by the force of the belleville spring 75. In the absence of an impulse form the hammer blow, the bar stock 77 is fixed in position with respect to its overlying housing 71 so that for all intents and purposes the bar stock is fixed in position for use as a table clamp.

Moreover, having thus described the invention it should be apparent that numerous structural modifications and adaptations may be resorted to without departing from the scope and fair meaning of this invention as delineated hereinabove and as described hereinbelow by the claims.

I claim:

1. A clamp device for holding workpieces in the formation of trusses, wherein the workpieces are supported on a substantially horizontal work surface, and wherein the work surface is provided with a plurality of openings, said clamp device comprising:

a body having a guideway formed thereon;

a bar slidably received in the guideway;

means for locking the bar in the guideway in a selected position;

the bar having a first end provided with a workpiece engaging means;

a plurality of keying elements carried on the body and adapted to be received in a corresponding plurality of openings in the work surface, thereby keying the clamp device to the work surface, and at least one of the keying elements being adjustably carried on the body such that the clamp device may be conveniently keyed to a selected plurality of openings in the work surface for clamping versatility, and such that a plurality of clamp devices may rigidly retain the workpieces while the workpieces are joined together;

wherein the means for locking the bar in the guideway comprises:

a cap of substantially annular configuration attached to the guideway;

the cap further having an end wall having a threaded opening therein;

a threaded bolt provided with threads complementary to the pitch of threads in the opening of the cap so that the bolt can be advanced in a direction transverse to the longitudinal axis of the bar;

the cap further supporting a puck having a necked down portion which can frictionally contact the bar with sufficient clearance being provided so that the magnitude of frictional contact of the puck can be adjusted by means of the bolt; and a washer having spring characteristics further being interposed between the bolt and the puck, such that, when locked, the bar remains in place against usual forces applied from any direction.

2. A clamp device for holding workpieces in the formation of trusses, wherein the workpieces are supported on a substantially horizontal work surface, and wherein the work surface is provided with a plurality of openings, said clamp device comprising:

a body having a guideway formed thereon;

a bar slidably received in the guideway;

means for locking the bar in the guideway in a selected position;

the bar having a first end provided with a workpiece engaging means;

a plurality of keying elements carried on the body and adapted to be received in a corresponding plurality of openings in the work surface, thereby keying the clamp device to the work surface, and at least one of the keying elements being adjustably carried on the body such that the clamp device may be conveniently keyed to a selected plurality of openings in the work surface for clamping versatility, and such that a plurality of clamp devices may rigidly retain the workpieces while the workpieces are joined together;

wherein the attachment of the device to the work surface comprises:

the body having a first end and a second end, a first substantially flat, elongated side, an opposite second side and a third side intermediate between the first side and the second side, the third side having an axial slot near the second end thereof;

the keying element being at least a first bolt and a second bolt, the bolts extending outwardly from the third side of the body;

the first bolt mounted near the first end of the third side;

a threaded shaft passing axially within the body;

a slide block mounted within the body, the slide block having a threaded bore therein, the threads being complementary to the threads on the threaded shaft so that axial translation of the slide block occurs on rotation of the threaded shaft;

the second bolt mounted on the slide block and extending outwardly through the axial slot in the body so that rotation of the threaded shaft advances the second bolt along the length of axial slot; and such that the first bolt may be received in an opening in the work surface and second bolt may be selectively disposed by rotation of the threaded shaft to be received in a second opening in the work surface whereby the device is securely disposed and does not move when forces are applied from any direction.

3. The device of claim 2, wherein the bolts are replaceable.

4. The device of claim 2, wherein the first side may be abutted to the workpiece and the device may be keyed to the work surface to rigidly retain the workpiece while the workpieces are joined together.

5. The device of claim 2, wherein the guideway is adjacent to the second side of the body; and the bar may be slidably engaged in the guideway such that the workpiece engaging means extends beyond the first end of the body.

6. The device of claim 2, wherein the guideway is adjacent to the second side of the body; and the bar may be slidably engaged in the guideway such that the workpiece engaging means extends beyond the second end of the body.

7. A clamp device for holding workpieces in the formation of trusses, wherein the workpieces are supported on a substantially horizontal work surface, and wherein the work surface is provided with a plurality of openings, said clamp device comprising:

a body having a guideway formed thereon;

a bar slidably received in the guideway;

means for locking the bar in the guideway in a selected position further comprising a cap of substantially annular configuration attached to the guideway, the cap further having an end wall having a threaded opening therein, a threaded bolt provided with threads complementary to the pitch of threads in the opening of the cap so that the bolt can be advanced in a direction transverse to the longitudinal axis of the bar, the cap further supporting a puck having a necked down portion which can frictionally contact the bar with sufficient clearance being provided so that the magnitude of frictional contact of the puck can be adjusted by means of the bolt, a washer having spring characteristics further being interposed between the bolt and the puck, such that, when locked, the bar remains in place against usual forces applied from any direction;

the bar having a first end, the first end having a workpiece engaging means, the means being an arcuate plate carried on the first end of the bar such that the arcuate plate may abut the workpiece from any direction and permit force to applied to the workpiece; and a plurality of keying elements carried on the body and adapted to be received in a corresponding plurality of openings in the work surface, thereby keying the clamp device to the work surface comprising, the body having a first end and a second end, a first substantially flat, elongated side, an opposite second side and a third side intermediate between the first side and the second side, the third side having an axial slot near the second end thereof, the keying elements being at least a first bolt and a second bolt, the bolts extending outwardly from the third side of the body, the first bolt mounted near the first end of the third side, a threaded shaft passing axially within the body, a slide block mounted within the body, the slide block having a threaded bore therein, the threads being complementary to the threads on the threaded shaft so that axial translation of the slide block occurs on rotation of the threaded shaft, the second bolt mounted on the slide block and extending outwardly through the axial slot in the body so that rotation of the threaded shaft advances the second bolt along the length of axial slot, such that the first bolt may be received in an opening in the work surface and second bolt may be selectively disposed by rotation of the threaded shaft to be received in a second opening in the work surface whereby the device is securely disposed and does not move when forces are applied from any direction.

8. A clamp device for holding workpieces in the formation of trusses, wherein the workpieces are supported on a substantially horizontal surface, and wherein the work surface is provided with a plurality of openings, said clamp device comprising:

a body having a substantially first flat elongated side and an opposite second side, such that the first side may abut the workpiece, if desired;

a guideway formed on the second side of the body;

a bar reversibly and slidably received in the gateway;

the bar having a first end provided with a workpiece engaging means and a second end extendable beyond the guideway such that force may be applied to the second end of the bar;

the bar being received in the guideway in a plurality of positions such that the workpiece engaging means may be disposed in a selected position;

means for locking the bar in the guideway in a selected position;

at least two keying elements carried on the body and adapted to be received in corresponding openings in the work surface, thereby keying and securely attaching the clamp device to the work surface; and wherein the keying elements are adjustably carried by the body such that the clamp device may be conveniently keyed to a selected plurality of openings in the work surface for clamping versatility and attachment of the device to the work surface.

9. The device of claim 8, wherein the attachment of the device to the work surface comprises:

the body having a first end and a second end, and a third side intermediate between the first side and the second side, the third side having an axial slot near the second end thereof;

the keying elements being at least a first bold and a second bolt, the bolts extending outwardly from the third side of the body;

the first bolt mounted near the first end of the third side;

a threaded shaft passing axially within the body;

a slide block mounted within the body, the slide block having a threaded bore therein, the threads being complementary to the threads on the threaded shaft so that axial translation of the slide block occurs on rotation of the threaded shaft;

the second bolt mounted on the slide block and extending outwardly through the axial slot in the body so that rotation of the threaded shaft advances the second bolt along the length of axial slot; and such that the first bolt may be received in an opening in the work surface and second bolt may be selectively disposed by rotation of the threaded shaft to be received in a second opening in the work surface whereby the device is securely disposed and does not move when forces are applied from any direction.

* * * * *